US005553492A

United States Patent [19]

Barrett et al.

[11] Patent Number: 5,553,492

[45] Date of Patent: Sep. 10, 1996

[54] MEASURING SYSTEM FOR MEASURING REAL TIME GROUNDWATER DATA

[75] Inventors: Daniel P. Barrett, Minneapolis, Minn.; Roger J. Davis, Hudson, Wis.; John E. Dustman, Inver Grove Heights, Minn.; Dawn R. Gibas, Minneapolis, Minn.; Bradley G. L. Stevens, Plymouth, Minn.; Barry T. Wilson, St. Paul, Minn.

[73] Assignee: Summit Envirosolutions, Inc., Minneapolis, Minn.

[21] Appl. No.: 432,025

[22] Filed: May 1, 1995

[51] Int. Cl.[6] ..... E21B 49/08; E91B 47/00

[52] U.S. Cl. ..... 73/152.29; 73/152.18

[58] Field of Search ..... 73/155, 152, 151

[56] References Cited

U.S. PATENT DOCUMENTS

| | | | |
|---|---|---|---|
| 4,461,172 | 7/1984 | McKee et al. | 73/155 |
| 4,620,189 | 10/1986 | Fargue | 73/155 |
| 4,814,711 | 3/1989 | Olsen et al. | 324/326 |
| 5,126,978 | 6/1992 | Chaum . | |
| 5,189,909 | 3/1993 | Oike et al. | 73/155 |
| 5,357,482 | 10/1994 | O'Sullivan et al. | 73/155 |

OTHER PUBLICATIONS

L. Queen, et al., "The Basics of Geographic Information Systems", Minnesota Extension Service (1993). pp. 1–16.

*Primary Examiner*—Richard Chilcot
*Assistant Examiner*—Max Noori
*Attorney, Agent, or Firm*—Patterson & Keough, P.A.

[57] ABSTRACT

A measuring system for measuring real time groundwater data and graphically depicting the data for analysis and interpretation is disclosed. At least one transducer is positioned in a well to be modeled. A control unit is provided to acquire data from the transducer and to store the data acquired. A home base unit is provided to receive data from the control unit. The home base unit contains a geographic information system program for processing the data. A display unit is connected to the home base unit for displaying the data received.

4 Claims, 7 Drawing Sheets

MEASURING SYSTEM FOR MEASURING REAL TIME GROUNDWATER DATA

BACKGROUND OF THE INVENTION

The present invention is a system for providing a model of groundwater flow based on real time groundwater data. Specifically, the present invention is a system for collecting real time groundwater data and processing same to form a model of the groundwater flow which is graphically depicted in three dimensions.

Increased use and importance of groundwater as a source of municipal water supplies has increased the need for understanding and managing groundwater resources. The 1986 amendments to the federal Safe Drinking Water Act focus on protecting municipal well fields through the designation of wellhead protection ground regions thereabout and the management of the included subsurface and surface areas. A wellhead protection area (WHPA) is defined as a surface and the region therebelow down to the aquifer (usually termed the subsurface area) surrounding a public well or well field. This is the region through which contaminants are likely to move toward and reach the well or well field. By delineating the WHPA, contaminant sources within the WHPA can be managed to eliminate or attenuate their impact on well water quality.

The promulgation of environmental regulations and laws governing industries, businesses and individuals has created a need for a wide range of services related to the development, management, assessment and protection of groundwater resources. A successful wellhead protection program involves the following elements: 1) inventorying sources of contamination; 2) delineating the wellhead protection area; 3) developing a strategy for managing sources of contamination; 4) assessing well and aquifer vulnerability; 5) developing a scheme for monitoring groundwater quality in the WHPA; and 6) developing contingency plans in the event of well field contamination. Geographic information systems (GIS) provide a powerful tool for the development and presentation of each of the components of a wellhead protection strategy.

A GIS, which includes data, hardware, software and users, is a computerized, integrated system used to compile, store, manipulate and output mapped spatial data. A GIS may be used to quickly access an integrated, geographically-referenced database of attributes for creating a map that can be overlaid, combined, manipulated and analyzed to user specifications. Many people have utilized a GIS for the storage and processing of environmental data. Specifically, a GIS has been used to link a previously existing groundwater flow models with newly obtained data from the corresponding WHPA, such that the resulting model output could be integrated within the GIS database from which further maps can be generated for that specific WHPA. In addition, the resulting model within the GIS database can be used with varying data set inputs for multiple model runs, or to provide inputs for a number of other different models. The ability to link groundwater flow models and GIS databases to create three-dimensional representations of corresponding geological and hydrological systems is also known.

The groundwater industry, including businesses for groundwater supply management and the management of groundwater resources, relies on classical hydrogeologic principles to characterize aquifer flow systems. The accuracy of the output results for computed groundwater flows based on measured data and the mathematical calculations specified by a model are limited by the quality and accuracy of the input data. In addition, the mathematics and physics associated with classic hydrogeologic principles often assume conditions for convenience or mathematical tractability that do not exist in reality. The present status of hydrogeologic assessments of groundwater flow typically involves the installation of wells that enable the monitoring of aquifer responses to stress (e.g., pumping). Aquifer parameters, including hydraulic conductivity, transmissivity, and storativity have historically been estimated or calculated through aquifer testing over a relatively short time period (hours to a few days). More recently, these data have been utilized in numerical and analytical groundwater flow models which provide long-term simulations of aquifer behavior. Unfortunately, the methods for data collection have not progressed at the same rate as the computer applications, particularly with respect to long-term characterization of flow.

Often, the data collected to characterize aquifer systems represents a relatively small "snapshot in time" of the aquifer response to stress. As a result of this process, errors accumulate during the modeling task based on this data due to anisotropy, heterogeneity and boundaries affecting flow conditions in the WHPA not apparent during the short-term aquifer tests. These errors could be greatly reduced by providing a mechanism for collecting real time data directly from remote locations continually and providing a model of the flow over time giving results that can be graphically depicted over the long-term data for analysis and interpretation.

SUMMARY OF THE INVENTION

The present invention provides a unique and cost effective approach to the protection, assessment and remediation of groundwater resources. The present invention integrates currently available technologies to improve existing data acquisition, analysis and presentation capabilities at a cost savings of ten to 30 percent over conventional assessment and management techniques. The cost savings are found in less field and mobilization time, lower equipment costs and less time spent in data conversion, data analysis and graphical depiction of results. Additionally, not only does the present invention have cost savings, the groundwater sites can now be characterized with greater speed and accuracy. Telecommunication links are utilized to enable efficient access to remote data and to provide and depict the data in real time.

The present invention is a measuring system for measuring real time groundwater data and graphically depicting the data for analysis and interpretation. This system includes at least one transducer positioned in at least one well which is to be modeled. A control unit is provided to acquire data from the transducer and to store the data acquired. A home base unit is provided to receive data from the control unit. A display unit is connected to the home base unit for displaying the data received.

DETAILED DESCRIPTION OF THE PREFERRED EMBODIMENTS

There are two primary situations in which the present invention is typically used. The first is a municipal site where wellheads will be inside an enclosure, such as a building. Within those buildings, there is electricity, valving and control systems for the well and the pumps. These municipal wells provide water to a city or town. The present invention may be used in the municipal site situation to monitor and manage the water supply to the municipalities. The other typical situation for use of the present invention is at an investigative site or at a site where groundwater remediation is being considered. In this type of situation, there is typically one well out of which water is desired to be pumped and a series of nearby monitoring wells at various distances away from the pumping well. There may also be a number of pumping wells and monitoring wells depending on the size of the wellhead protection area (WHPA). In remedial situations, the present invention may be used in connection with satisfying EPA mandated wellhead protection plans, superfund investigations and remediations, underground storage tank investigations and remediations, water supply management and miscellaneous groundwater studies. The embodiments illustrated and described in the preferred embodiment of the present invention are directed to a remedial site, but could also be used for municipal situations or other applications without departing from the spirit and scope of the invention.

Figure 1:
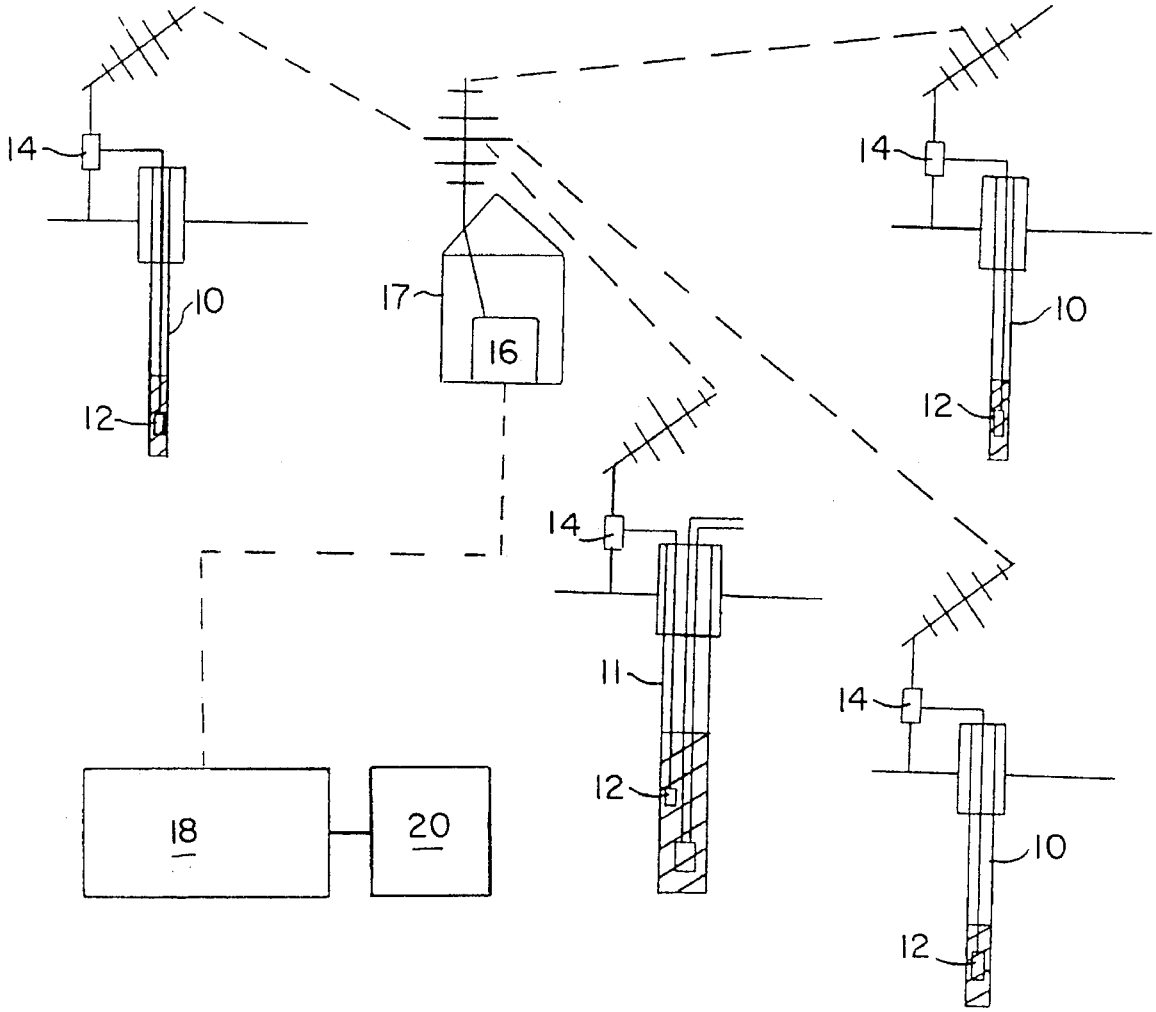
FIG. 1 is a schematic representation of a system according to the present invention.

FIG. 1 is a schematic illustration of a remedial site equipped with the system of the present invention. As stated above, in a remedial site application, a number of monitoring wells 10 surround a pumping well 11. The monitoring wells 10 may be hundreds of feet to miles away from the pumping well 11, depending on the size of the well field. At least one pressure transducer 12 is mounted below the water table in the pumping well 11 and in each monitoring well 10. Such transducers 12 are commercially available as commonly known pressure transducers that measure pounds per square inch of water pressure, which can then be converted into groundwater elevation depending on known conditions such as the size of the well and the placement of the transducer 12.

In order to determine the underground flow direction of water in the WHPA, and other conditions of the WHPA, it is necessary to have at least three monitoring wells around a pumping well. However, there may be more than one aquifer flow system, or water depth of interest that needs monitoring. For instance, a state agency or a federal agency may be interested in a deeper, regional flow system that may be contributing water to a municipal well in town. In that type of situation, additional monitoring wells would be placed in the deeper zones of interest.

A remote terminal unit (RTU) 14 is provided adjacent to each well containing a transducer 12. In the embodiment illustrated in FIG. 1, each RTU 14 is electrically connected to the transducer 12 in its corresponding monitoring well 10. The RTU collects data from the transducer 12 in a manner discussed in greater detail below. A central terminal unit (CTU) 16 is provided central to the RTUs 14 as illustrated. Typically, the CTU is housed inside a water treatment building of some sort 17, but this is not a necessity. The CTU 16 receives data from, and sends instructions to, the RTUs 14 via radio broadcast transmissions. Depending upon the number of input and output channels available on the CTU 16, each CTU 16 can handle a number of RTUs 14. Because the CTU 16 communicates with more than one RTU 14, the CTU 16 must keep track of which RTU 14 it is communicating with for proper storage of the data received therefrom. The CTU 16 identifies which RTU 14 is sending it information with encoded signals. Not only does the CTU 16 receive data from and send instructions to the RTUs 14, it processes the data received and uses it in a flow model in a manner described in greater detail below.

A home base unit (HBU) 18 and display unit 20 are provided to communicate with any number of CTUs 16, and to provide the interface between a user and the system. The foundation for integrating the system parts, processing the measured data, and manipulating the model developed to display the three-dimensional flow field result is a geographic information system (GIS) computer program that resides in the HBU 18. GIS programs are known in the industry and the program used in the preferred embodiment is a vector-based ARC/INFO. The display unit 20 is connected to the HBU 18 to display data and results in a desired format.

Figure 2:
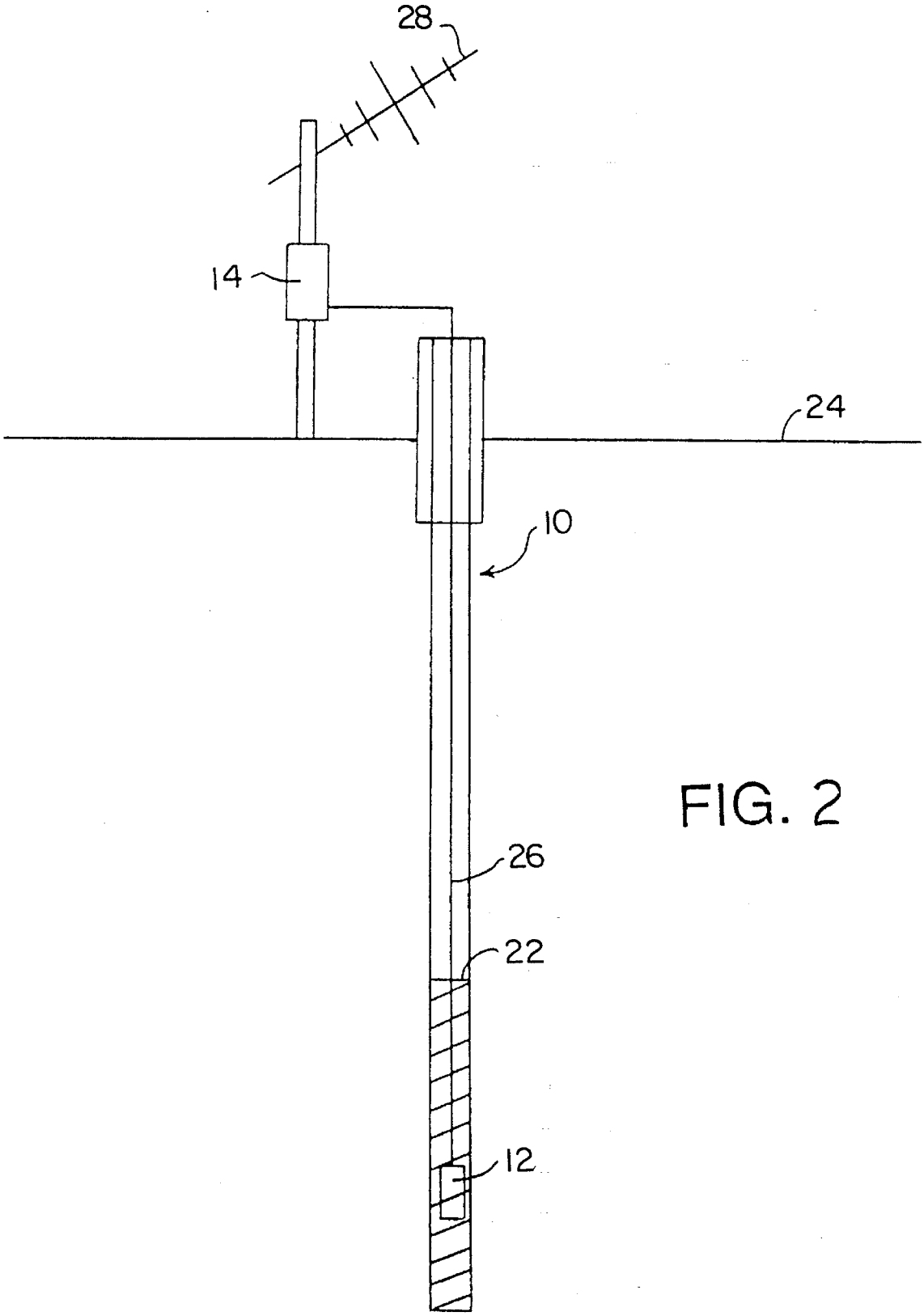
FIG. 2 illustrates a monitoring well having a transducer connected to a remote terminal unit.

FIG. 2 illustrates a monitoring well 10 with a pressure transducer 12 and a remote terminal unit 14 according to the present invention. As illustrated in FIG. 2, the monitoring well 10 extends from a point below the water table 22 to a point above the ground 24. The pressure transducer 12 is suspended in the monitoring well 10 below the water table 22. A cable 26 is provided to suspend the transducer 12 and to connect it to the remote terminal unit 14. As previously mentioned, and as can be seen in FIG. 2, the remote terminal unit 14 is positioned above the ground 24 adjacent the monitoring well 10. An antenna 28 is provided on the remote terminal unit 14 to receive and transmit signals to the central terminal unit 16.

Figure 3:
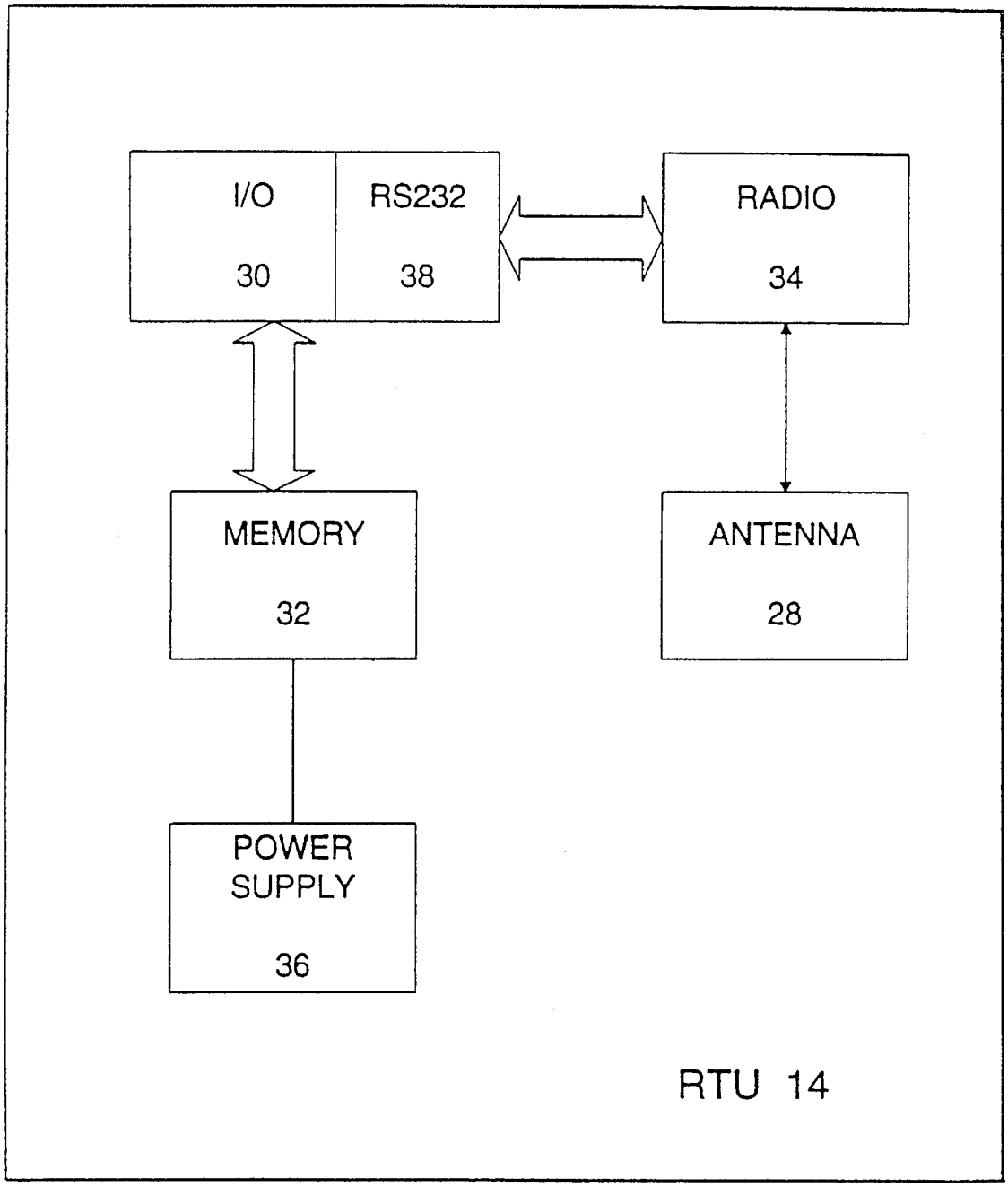
FIG. 3 illustrates a block diagram of the remote terminal unit of the present invention.

A RTU 14 is shown in greater detail in FIG. 3. The RTU 14 contains an input/output (I/O) device 30, a memory device 32, a radio transmitter and receiver (transceiver) 34, the antenna 28 and a power supply 36. The I/O device 30 receives data from the pressure transducer 12. The I/O device 30 also contains a data transfer module 38 with a RS232 communication port which allows direct coupling to a computer or other outside devices. The memory device 32 is a nonvolatile memory, having a capacity of approximately 8 megabytes in a typical embodiment. The transceiver 34 allows data to be transferred via broadcasting at radio frequencies to the CTU 16 when desired, and to receive commands from the CTU 16 as will be described in greater detail below. The RTUs 14 used in the preferred embodiment are very low power units in which the RF transceiver 34 transmits at about 2 watts UHF frequency. Therefore, a large power supply is not necessary. A solar-powered battery with solar panels is used for the primary power supply 36 of a typical embodiment, but a 12V battery power supply may also be used without departing from the spirit of the invention. It is also possible to use an AC adaptor to power the RTU 14 if there is a readily available source of electricity from an AC generator. The RTUs 14 only collect data from the transducers 12 when instructed to do so by the CTU 16 via the transducer 34. When it is not collecting data, the RTU 14 is in a "sleep" or idle mode, which reduces the power requirements for the system.

Figure 4:
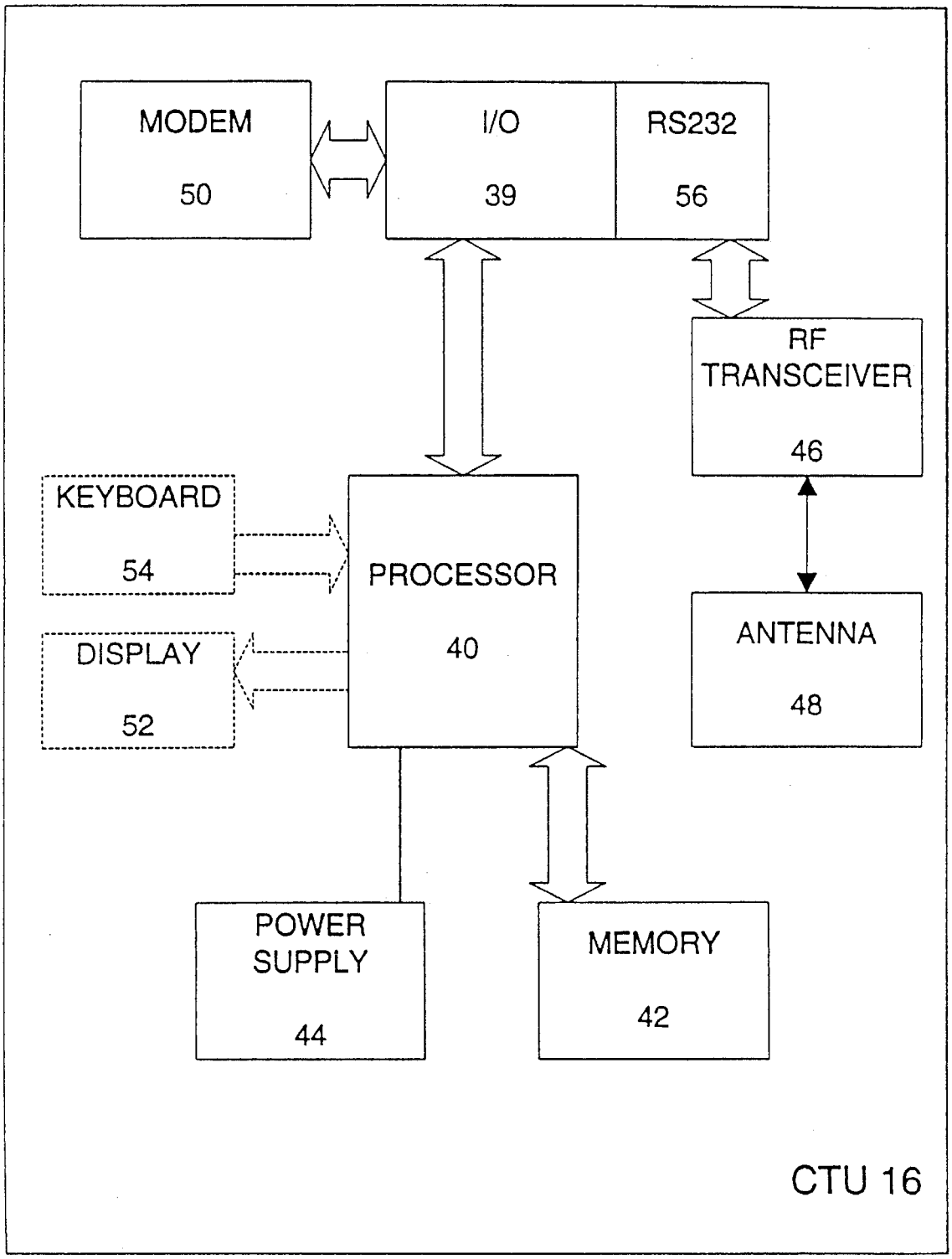
FIG. 4 illustrates a block diagram of a central terminal unit of the present invention.

FIG. 4 illustrates a CTU 16 in detail. The CTU 16 is a self-contained computer system having an input and output (I/O) device 39, a processor 40, an expanded memory 42, a power supply 44, an RF transmitter and receiver (transceiver) 46, an antenna 48 and a modem 50. A display 52 and a keyboard 54, are shown in dashed lines as optional equipment. As with the RTU, the I/O device 39 of the CTU 16 contains a data transfer module 56 with an RS232 port. The I/O device 39 is the communication link to the processor 40. Expanded memory 42 allows for a substantial amount of data to be saved by the CTU 16. The expanded memory 42 in a typical embodiment is a nonvolatile memory having a capacity of approximately 300 or more megabytes. The power supply 44 of the CTU 16 is typically an AC power supply. This is because the CTU 16 is typically housed inside a facility with commercially generated electricity available. If necessary, the power supply could be solar powered or battery-operated. The transceiver 46 is for sending and receiving signals at radio frequencies to and from remote radios in any number of RTUs. The modem 50 is provided to allow the CTU 16 to communicate with the HBU 18 via a telephone linkage. The modem 50 may either be a standard telephone line modem or a cellular telephone modem.

The CTU 16 is programmed to retrieve groundwater elevation data from the RTUs based on a retrieval strategy set by the system administrator. The CTU 16 is programmed to reduce the number of data points stored in its memory 42 by sorting out repetitive or unnecessary data points. For example, the system administrator may program the CTU 16 to monitor the well every second, and to record the data if the level of water in the well changes by 5/100 of a foot or more. Thus, even though the transducer is continuously monitoring the level of water in the well, and the CTU 16 will be checking the level of water in the well every second, data will only be recorded by the CTU when a change of 5/100 of a foot has occurred. This greatly reduces the number of data points stored in the CTUs' memory 42. If the water level for every second was recorded, there would be 86,400 data points to enter in just one day.

Figure 5:
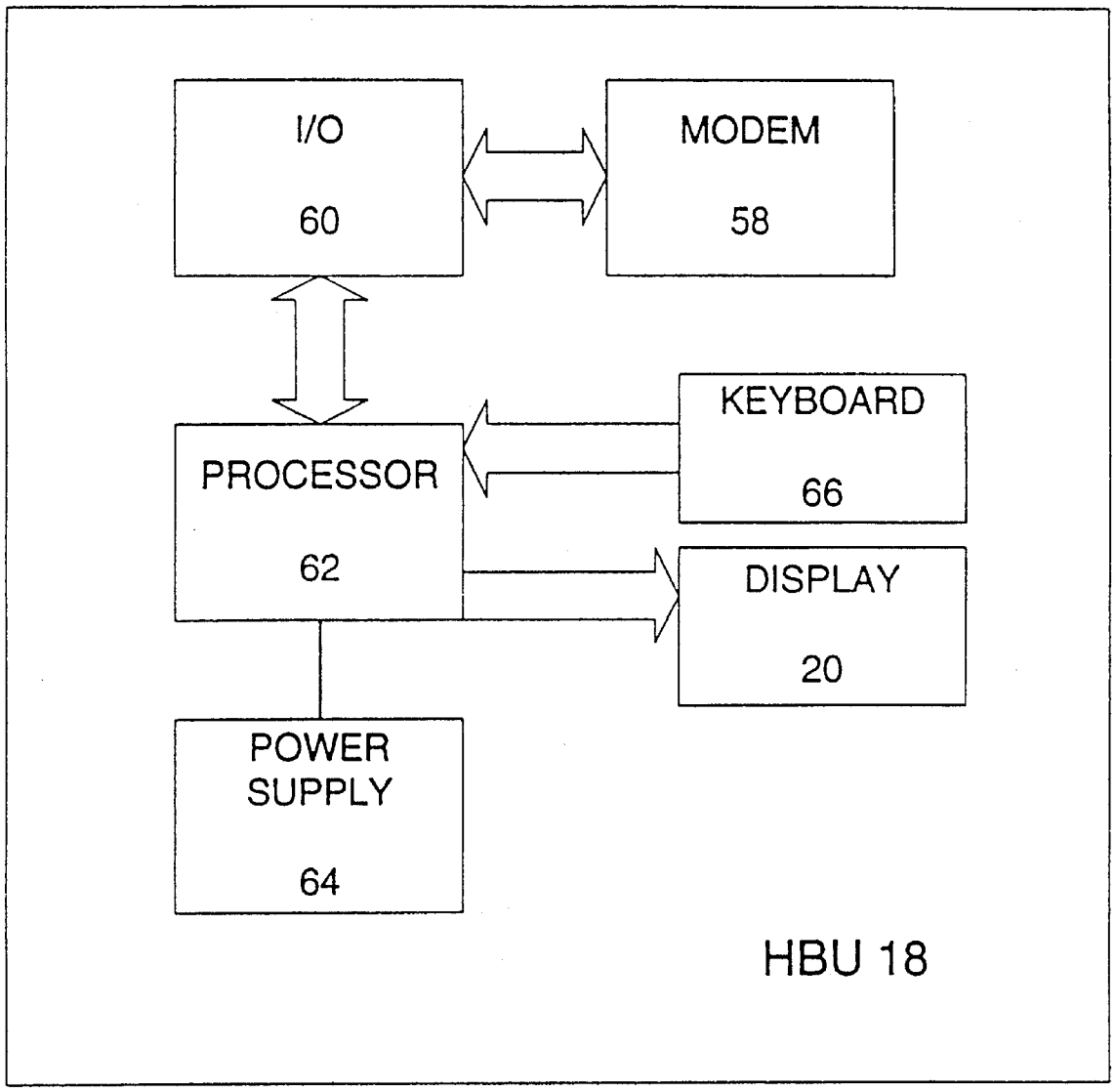
FIG. 5 illustrates a block diagram of a home base unit of the present invention.

The HBU 18 is shown in greater detail in FIG. 5. It includes modem 58, I/O device 60, processor 62, power supply 64, display 20 and keyboard 66. The modem 58 allows communication to any one of a number of CTUs 16. As with the CTUs, the modem 58 may be a standard telephone line modem or a cellular telephone modem. The I/O device 60 allows for communication to and from the processor 60. The HBU, as stated above, contains a GIS program for compiling and storing measured data, manipulating data and outputting spatially distributed data on mappings of the WHPA. Since the HBU is housed in an office setting where commercially generated electricity is readily available, the power supply of the HBU 18 is a standard AC power supply. If for some reason such electrical power is not readily available, the power supply could be a battery or a solar-powered battery. The processor 62 used in the typical HBU embodiment is a Silicon Graphics Indigo$^2$ workstation.

The data that is received by the HBU is processed by the GIS program residing on the processor 62. The GIS program used in the preferred embodiment comprises commercially available software packages such as ArcView by ESRI, ARC/INFO by ESRI and EXPLORER by Silicon Graphics. The ArcView program by ESRI is the system from which the other programs are run. It acts as the user interface ARC/INFO is a specialized spatial database program in which data received from the CTU are organized and stored. ARC/INFO has data processing routines that allow the user to interpolate between data points obtained in the measuring process to permit an inference of the groundwater parameters for other groundwater surface locations. These data processing routines include provisions for kriging, inverse distance weighting and trending as alternative interpolation processes. Kriging is a geostatistical procedure that generates an estimated surface from a scattered set of points with Z (third dimension) values. Inverse distance weighting is an interpolation procedure that determines cell values using a linearly weighted combination of a set of sample points, wherein the weighting is a function of inverse distance. Trending is a procedure for using a polynomial regression to fit a least squares surface to the input points. Where applicable, commercially available numerical and analytical groundwater flow and solute transport models (e.g. ModFlow, SLAEM, MT3D, etc.) will run utilizing the data stored in the GIS. Once the interpolated or modeled data has been generated, that data and the corresponding measured data are translated into a form usable by the EXPLORER program. The EXPLORER program is a visualization program that allows results obtained from ARC/INFO to be displayed and manipulated in three dimensions.

Figure 6:
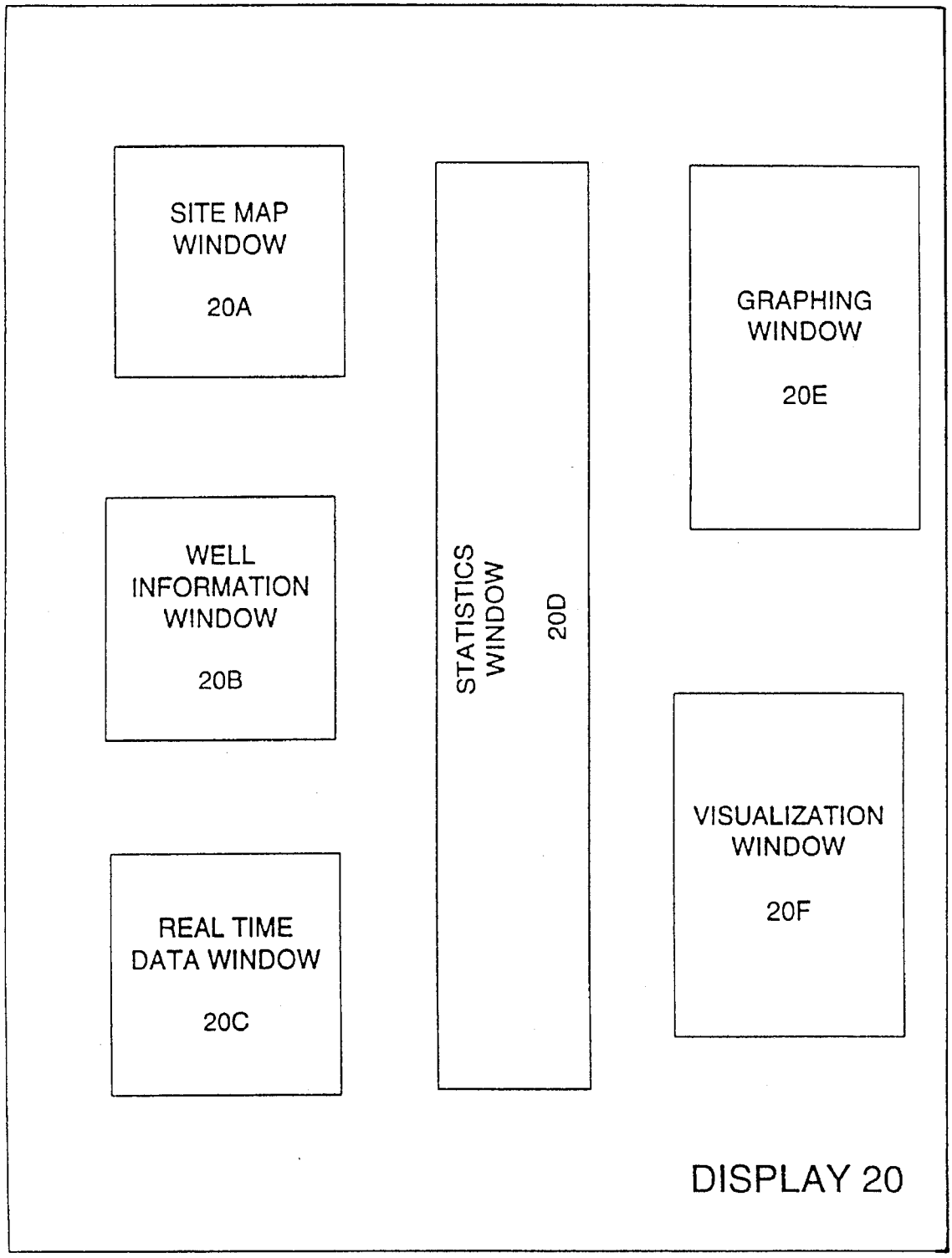
FIG. 6 illustrates a sample of a display output of the present invention.

The display format of the preferred embodiment is shown in detail in FIG. 6, but it should be understood that many alternative display formats could be used without departing from the spirit and scope of the invention. For example, a map could be printed onto a printer or a tabular format of data points could be printed onto a printer. As illustrated in FIG. 6, the display format of the preferred embodiment is a computer-based display exhibiting multiple screen "windows". The computer screen is divided into six viewing windows, 20*a*–20*f*. The first viewing window is a site map window 20*a*. This window shows the location of the wells being monitored. The next viewing window is a well information window 20*b*, which shows specific information of the well being monitored, such as the depth of the well, the length of the screen, the depth of the groundwater, the diameter of the well. The next viewing window is a current data window 20*c* which illustrates the most current data (and oftentimes real time data) for selected wells as read from the pressure transducers. The next viewing window is a statistics window 20*d* which gives statistics for selected wells and data points. The fifth viewing window is a graphing window 20*e* wherein a graph of data for a selected well is shown in format such as flow versus time or draw down versus time. The final viewing window is a visualization window 20*f* which shows three-dimensional groundwater surface maps and two-dimensional contour maps of the groundwater surface of the WHPA and the containment sources.

The preferred embodiment may also be configured with equipment to monitor flow in the pumping well 11 and to remotely control flow in the pumping well 11. One type of flow monitoring equipment that may be used is a turbine flow meter. Many different variations of a turbine flow meter may be used depending upon the specifications of the site. Equipment to remotely control flow include variable frequency drives and modulating ball valves.

In operation, once the monitoring wells and the pumping well are equipped, the purpose of the system is to get data acquired by the CTU 16 to the HBU 18 for interpretation. As previously stated, a monitoring scheme is devised with a selected sampling interval schedule stored in the CTU 16. When data is desired from the RTUs in accordance with this schedule, the CTU sends a wake-up command to the RTUs from which data is desired. Depending on the information desired, the CTU then drops any unwanted or unnecessary data and saves only the desired data points in its memory 42. The operator at the HBU then requests information from the CTU 16. Information from the CTU 16 is passed to the HBU 18 by modem 50. Upon receiving the data on the HBU modem 58, the GIS program stored on the processor 62 compiles and stores the measured data, manipulates that data and the models established thereon to output a groundwater parameter map to the display 20.

Figure 7:
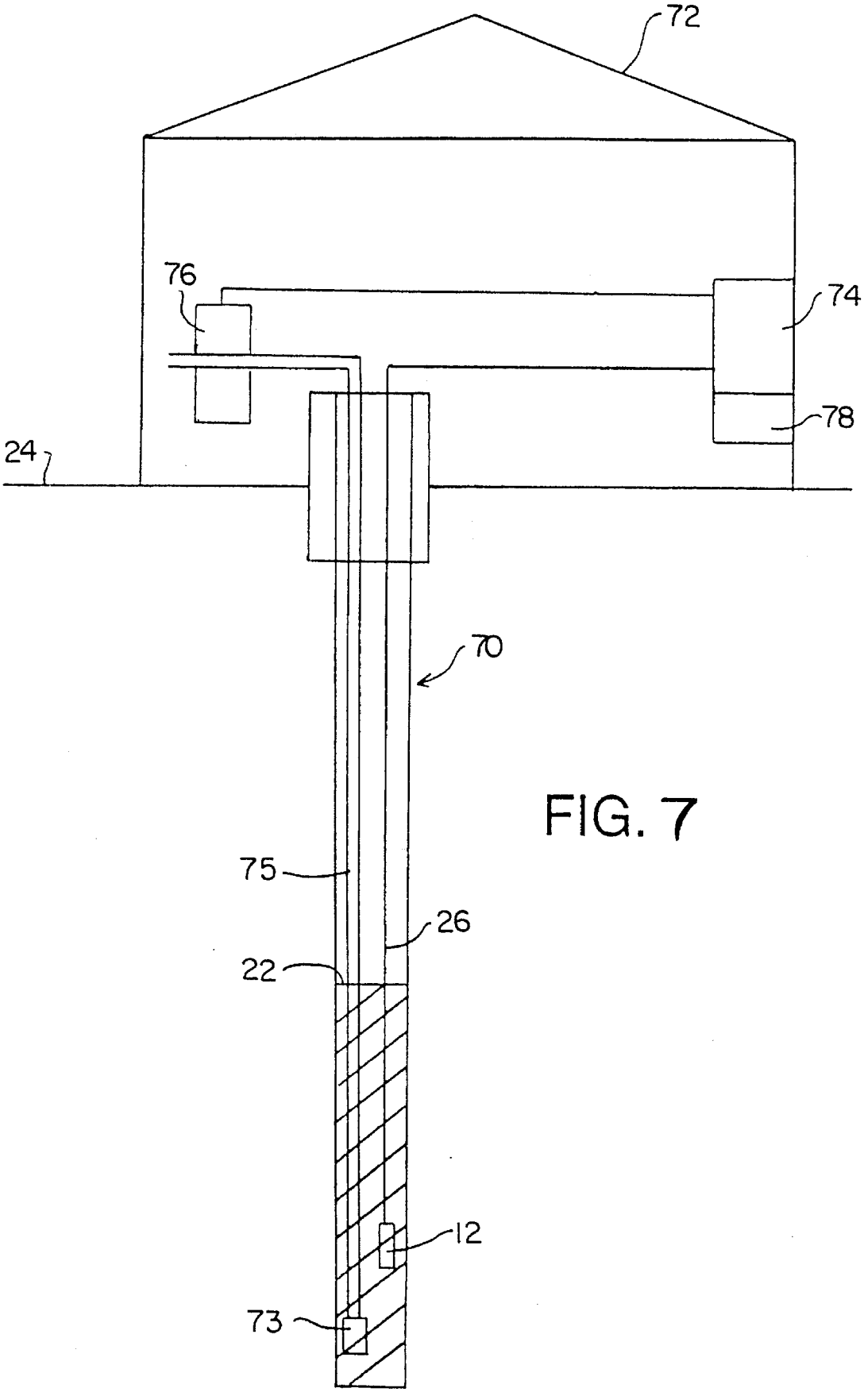
FIG. 7 illustrates a municipal well having a transducer connected to a control panel.

FIG. 7 illustrates a municipal well application equipped with the present invention. In this embodiment, like parts from the previous embodiment will be correspondingly numbered. A well 70 is shown in a building 72. As illustrated, the well 70 extends from a point below the water table 22 to a point above the ground 24. A control panel 74 is provided to control a pump 73 in the well 70. A transducer 12 is suspended in the well below the water table 22. A cable 26 is provided to suspend the transducer 12 and to connect it also to the control panel 74. In this application, the transducer 12 is wired directly to the control panel 74, and there is no need for an RTU 14.

The pump 73 and a water table 75 are provided to pump water out of the well 70. A non-intrusive flow meter 76 is provided to measure the rate of flow of the well 70 as a result of such pumping. The flow meter 76 is also wired directly to the control panel 74. A memory unit 78 is electrically connected to the control panel 74 to store data received from the transducer 12. The control panel 74 is equipped with communication means (not shown) to communicate with the HBU 18 as described in the previous embodiment.

Although the present invention has been described with reference to preferred embodiments, workers skilled in the art will recognize that changes may be made in form and detail without departing from the spirit and scope of the invention.

What is claimed is:

1. A measuring system for measuring real time groundwater data from a plurality of wells and graphically depicting the data, the system comprising:

a plurality of transducers for placement in the plurality of wells, wherein at least one transducer is placed below the water table in each well;

a plurality of remote terminal units for collecting data from the transducers, wherein one remote terminal unit is positioned proximate each well and wherein each remote terminal unit is electrically connected to the at least one transducer in its corresponding well and wherein each remote terminal unit contains a radio frequency transmitter and receiver;

a plurality of central terminal units for remotely collecting, reducing and processing data from the plurality of remote terminal units wherein a single central terminal unit services a group of remote terminal units, and wherein each single central terminal unit is positioned substantially central to, but remote from, the corresponding group of remote terminal units, wherein the plurality of central terminal units contain a radio frequency transmitter and receiver for communication with the plurality of remote terminal units, and wherein the plurality of central terminal units contain a remote telecommunications unit;

a home base unit containing a geographic information system for compiling, storing, manipulating and outputting mapped data, the home base unit being remote from the plurality of central terminal units and wherein the home base unit contains a remote telecommunications unit for communicating with the remote telecommunications unit of the plurality of central terminal units; and a display unit connected to the home base unit for displaying the mapped data output from the home base unit in real time.

2. The system as in claim 1 wherein the remote terminal units are solar powered.

3. The system as in claim 1 wherein the display unit displays the data in three dimensions.

4. A method of measuring real time groundwater data of an area having a plurality of wells and graphically depicting the data with a system containing at least one transducer in each well, a plurality of remote terminal units electrically connected to the at least one transducer in its corresponding well and wherein each remote terminal unit contains a radio frequency transmitter and receiver, a plurality of central terminal units wherein a single central terminal unit services a group of remote terminal units, and wherein each single central terminal unit is positioned substantially central to, but remote from, the corresponding group of remote terminal units, wherein the plurality of central terminal units contain a radio frequency transmitter and receiver, and wherein the plurality of central terminal units contain a remote telecommunications unit, a home base unit containing a geographic information system and a remote telecommunications unit, and a display unit connected to the home base unit, the method including the steps of:

establishing a plurality of monitoring wells having a transducer in each well for measuring well data and providing a signal representation thereof;

using the plurality of remote terminal units to collect the data from the transducers;

transmitting the data collected by the plurality of remote terminal units from the remote terminal units to the plurality of central terminal units via the radio frequency transmitters of the remote terminal units;

using the radio frequency receivers of the plurality of central terminal units to receive the data transmitted by the plurality of remote terminal units;

processing the data in the plurality of central terminal units to eliminate unwanted data;

transmitting the processed data from the plurality of central terminal units to the home base unit via the remote telecommunication units of the plurality of central terminal units;

using the remote telecommunication unit of the home base unit to receive the processed data from the central terminal units;

interpolating the processed data in the home base unit to obtain parameter values for an area of groundwater locations;

obtaining a real time representation of the groundwater surface; and displaying the obtained real time representation on the display unit.

* * * * *

UNITED STATES PATENT AND TRADEMARK OFFICE

CERTIFICATE OF CORRECTION

PATENT NO. : 5,553,492
DATED : September 10, 1996
INVENTOR(S) : Daniel P. Barrett, et al.

It is certified that error appears in the above-indentified patent and that said Letters Patent is hereby corrected as shown below:

Column 1, line 5, insert the following paragraph -- This invention was made with Government support under contract NAS13-628 awarded by the National Aeronautics and Space Administration. The Government has certain rights in the invention -- therefore;

Column 1, line 51, delete "a" therefore;

Column 4, line 67, delete "transducer" and insert -- transceiver -- therefore; and Column 5, line 67, after "interface" insert -- . -- therefore.

Signed and Sealed this

Eighteenth Day of March, 1997

*Attest:*

Bruce Lehman

BRUCE LEHMAN

*Attesting Officer*

*Commissioner of Patents and Trademarks*